US010234801B2

(12) United States Patent
Takeuchi

(10) Patent No.: US 10,234,801 B2
(45) Date of Patent: Mar. 19, 2019

(54) FIXING DEVICE INCLUDING HEAT SOURCE FOR HEATING FIXING MEMBER AND IMAGE FORMING APPARATUS

(71) Applicant: KYOCERA Document Solutions Inc., Osaka (JP)

(72) Inventor: Toshimitsu Takeuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 11 days.

(21) Appl. No.: 15/969,152

(22) Filed: May 2, 2018

(65) Prior Publication Data

US 2018/0373188 A1 Dec. 27, 2018

(30) Foreign Application Priority Data

Jun. 21, 2017 (JP) ..... 2017-121180

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS 7,187,880 B2 * 3/2007 Senda ..... G03G 15/2042 219/216
2007/0217805 A1 * 9/2007 Inoue ..... G03G 15/2039 399/69
2014/0233991 A1 * 8/2014 Moon ..... G03G 15/2028 399/322

FOREIGN PATENT DOCUMENTS

JP H08-110731 A 4/1996
JP H09-197894 A 7/1997

* cited by examiner

*Primary Examiner* — Walter L Lindsay, Jr.
*Assistant Examiner* — Milton Gonzalez
(74) *Attorney, Agent, or Firm* — Studebaker & Brackett PC

(57) ABSTRACT

A fixing device includes a fixing member, a pressing member, a heat source, a detecting part and a control part. The pressing member forms a pressing area with the fixing member. A sheet is conveyed through the pressing area. The heat source includes a main heating part heating a center portion of the fixing member in a sheet width direction perpendicular to a conveying direction of the sheet and a sub heating part heating both end portions of the fixing member in the sheet width direction. The detecting part detects a temperature of the end portion of the fixing member. The control part determines operation timings of the main heating part and the sub heating part based on the temperature detected by the detecting part such that the center portion and the both end portions of the fixing member are heated to a constant temperature.

4 Claims, 8 Drawing Sheets

| END TEMPERATURE (℃) | DELAY TIME (second) |
|---|---|
| END TEMPERATURE < 35 | 4 |
| 35 ≦ END TEMPERATURE < 50 | 2 |
| 50 ≦ END TEMPERATURE < 80 | 1 |
| 80 ≦ END TEMPERATURE < 150 | 0. 2 |

FIG. 6

| END TEMPERATURE (℃) | DELAY TIME (second) |
|---|---|
| END TEMPERATURE < 35 | 4 |
| 35 ≦ END TEMPERATURE < 50 | 2 |
| 50 ≦ END TEMPERATURE < 80 | 1 |
| 80 ≦ END TEMPERATURE < 150 | 0. 2 |

FIXING DEVICE INCLUDING HEAT SOURCE FOR HEATING FIXING MEMBER AND IMAGE FORMING APPARATUS

INCORPORATION BY REFERENCE

This application is based on and claims the benefit of priority from Japanese Patent application No. 2017-121180 filed on Jun. 21, 2017, which is incorporated by reference in its entirety.

BACKGROUND

The present disclosure relates to a fixing device which fixes a toner image on a sheet and an image forming apparatus including the fixing device.

An electrophotographic type image forming apparatus, such as a copying machine and a printer, is provided with a fixing device which fixes a toner image transferred on a sheet on the sheet. The fixing device includes a fixing member to be heated and a pressing member being pressed against the fixing member to form a pressing area. By making the sheet pass through the pressing area, the toner image is heated and pressed and then fixed on the sheet.

The fixing member includes a thin tube and a coating layer provided around the thin tube. The thin tube is made of aluminum or iron, and the coating layer is made of PFA or PTFE. The coating layer eliminates an adhesion of the toner on the fixing member and charging of the fixing member. In order to prevent occurrence of wrinkle on the sheet, the fixing member may be formed in an inverted crown shape in which an outer diameter is smaller at the center portion than at the both end portions in a sheet width direction perpendicular to a sheet conveying direction. The fixing device further includes a separating claw which comes into contact with the fixing member with a predetermined pressure and separates the sheet from the fixing member. The separating claw is made of polyimide resin coated with PFA, for example.

In order to reduce energy consumption of the fixing device with recent energy saving, a low melting point toner and a fixing member having a low heat capacity are developed. As a specific method to make the fixing member have a low heat capacity, the fixing member is made to have a small diameter or a thin thickness. Additionally, as a heater for heating the fixing member, an inexpensive halogen heater is conventionally used. Corresponding to a high-speed image forming apparatus, a plural of heaters may be used. The plural of heaters include a main heater heating the center portion in the sheet with direction and a sub heater heating the both end portions in the sheet width direction. In view of fixing ability at continuous printing, a power consumption of the main heater is made to be higher than that of the sub heater.

In a case where the plural of heaters are used, because rush current increases if they are turned on at the same time, the heaters are turned on with time difference. Conventionally, the sub heater is firstly turned on and then the main heater is turned on after one cycle of a lighting time of the heater (for example, 200 ms in case of 50 Hz) elapses. However, if the heaters are turned on at such a timing, because the main heater has a power consumption larger than that of the sub heater, a period in which a temperature of the center portion rises to a fixing allowable temperature is shorter than a period in which a temperature of the both end portions rises to the fixing allowable temperature. Then, until the temperature of the both end portions rises to the fixing allowable temperature and the fixing member is uniformly heated in the sheet width direction, it is required to wait the start of the fixing operation. During the waiting time, in order to keep the temperature of the center portion the fixing allowable temperature, the main heater is turned on and off at a constant interval, and unnecessary power is consumed by the turn on/off of the main heater during the waiting time.

The fixing device is sometimes configured to turn on a heat source having a smaller power consumption first among a plural of heat sources. Alternatively, the fixing device is sometimes configured to include a first heater having a small rush current and a second heater having a large rush current and fast temperature rising time, and to turn on the first heater first.

In the fixing devices having the above configurations, it becomes possible to eliminate the increasing of the rush current. However, they have no consideration about the temperature unevenness due to a difference in the temperature rising period between the center portion and the both end portions and about increasing of the power consumption.

SUMMARY

In accordance with an aspect of the present disclosure, a fixing device includes a fixing member, a pressing member, a heat source, a detecting part and a control part. The pressing member forms a pressing area with the fixing member. A sheet is conveyed through the pressing area. The heat source includes a main heating part heating a center portion of the fixing member in a sheet width direction perpendicular to a conveying direction of the sheet and a sub heating part heating both end portions of the fixing member in the sheet width direction. The detecting part detects a temperature of the end portion of the fixing member. The control part determines operation timings of the main heating part and the sub heating part based on the temperature detected by the detecting part such that the center portion and the both end portions of the fixing member are heated to a constant temperature.

In accordance with an aspect of the present disclosure, an image forming apparatus includes an image forming part and the fixing device. The image forming part forms a toner image on a sheet. The fixing device fixes the toner image on the sheet.

The above and other objects, features, and advantages of the present disclosure will become more apparent from the following description when taken in conjunction with the accompanying drawings in which a preferred embodiment of the present disclosure is shown byway of illustrative example.

BRIEF DESCRIPTION OF THE DRAWINGS

FIG. 6 is a table showing a relationship between an end temperature and a delay time, in the fixing device according to the embodiment of the present disclosure.

DETAILED DESCRIPTION

Hereinafter, with reference to the attached drawings, a fixing device and an image forming apparatus according to one embodiment of the present disclosure will be described.

Figure 1:
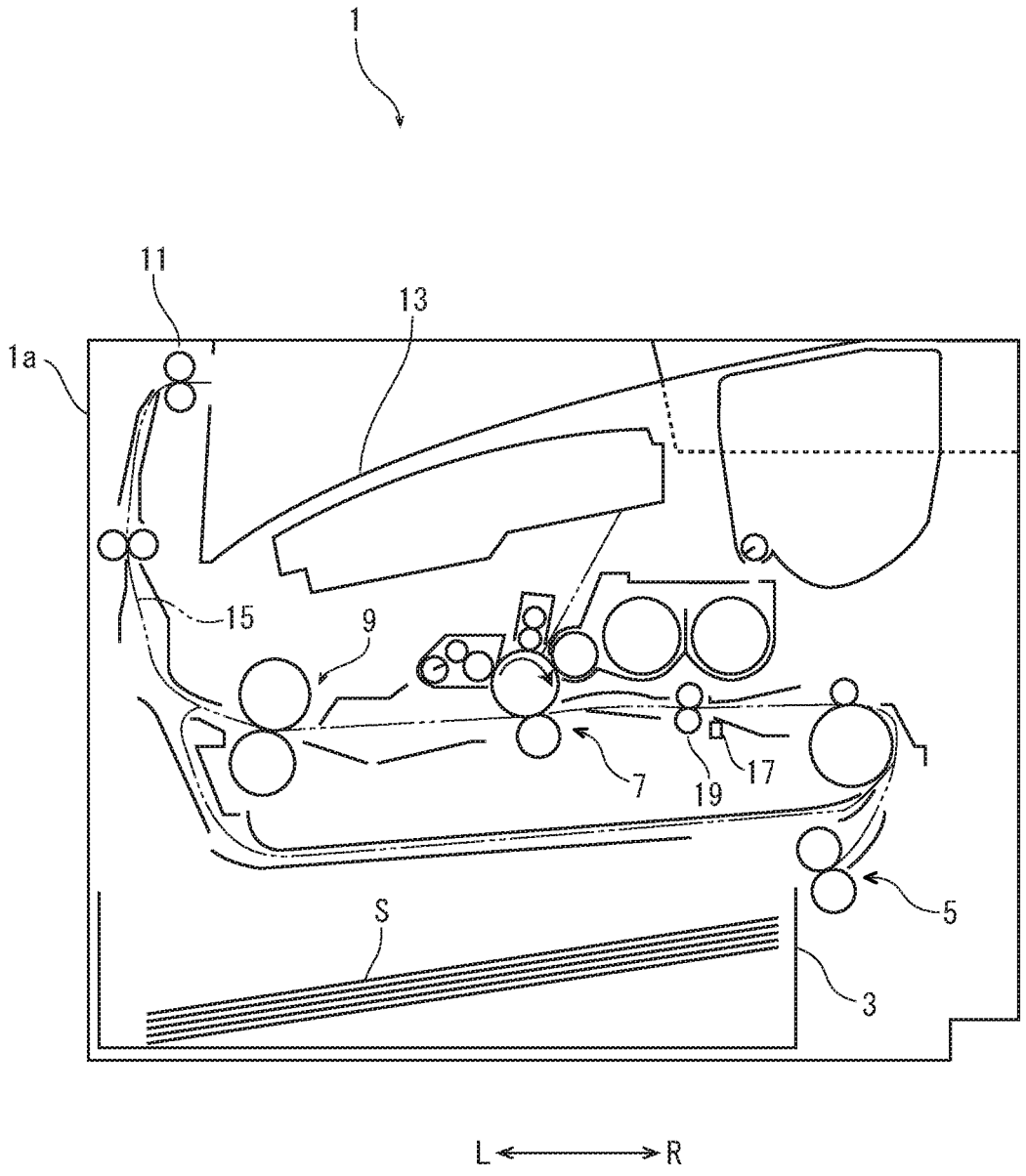
FIG. 1 is a front view schematically showing an inner structure of a printer according to one embodiment of the present disclosure.
Figure 2:
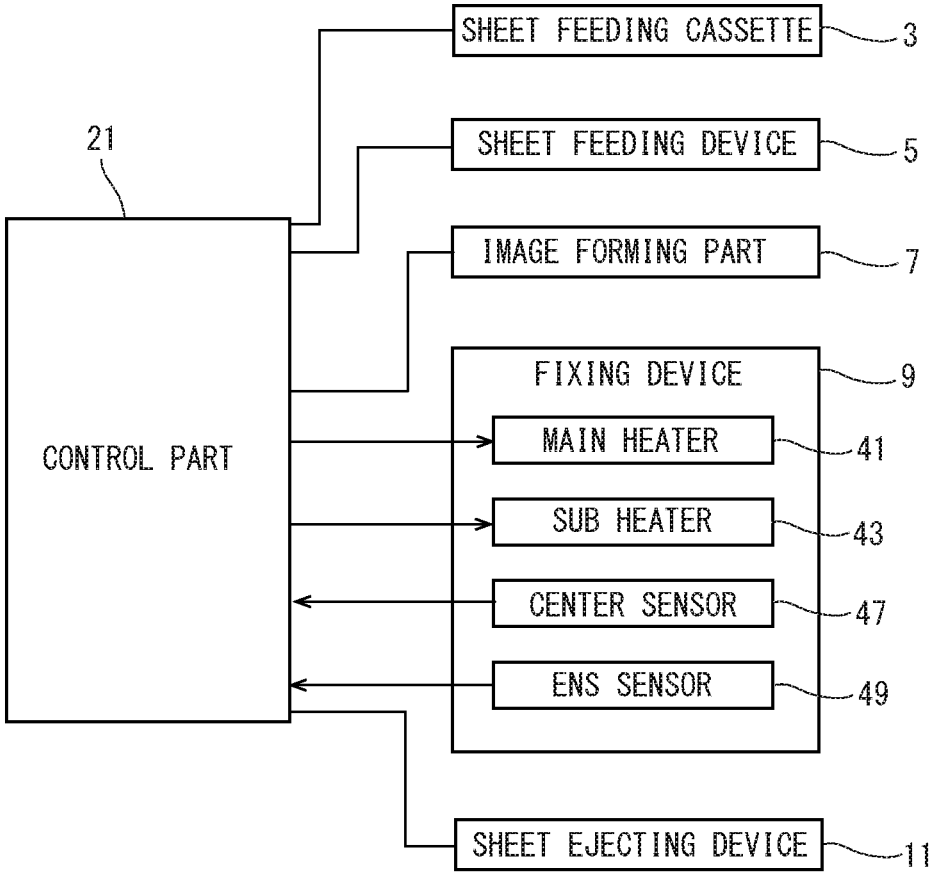
FIG. 2 is a block diagram of a control part of the printer according to the embodiment of the present disclosure.

With reference to FIG. 1 and FIG. 2, an entire structure of a printer 1 as an image forming apparatus will be described. FIG. 1 is a front view schematically showing an inner structure of the printer 1, and FIG. 2 is a block diagram of a control part. In the following description, a near side (a front side) of a paper plan of FIG. 1 is decided to be a front side of the printer 1. In each figure, Fr, Rr, L and R respectively indicate a front side, a rear side, a left side and a right side of the printer 1.

An apparatus main body 1*a* of the printer 1 is provided with a sheet feeding cassette 3 storing a sheet S, a sheet feeding device 5 feeding the sheet S from the sheet feeding cassette 3, an image forming part 7 forming a toner image on the sheet S, a fixing device 9 fixing the toner image on the sheet S, an ejecting device 11 ejecting the sheet S and an ejected sheet tray 13. In the apparatus main body 1*a*, a conveying path 15 for the sheet S is formed so as to extend from the sheet feeding device 5 to the ejecting device 11 through the image forming part 7 and the fixing device 9. On the conveying path 15, a sheet detecting sensor 17 and a pair of resist rollers 19 are provided between the sheet feeding device 5 and the image forming part 7. As shown in FIG. 2, the printer 1 is provided with a control part 21 electrically connected to the sheet feeding cassette 3, the sheet feeding device 5, the image forming part 7, the fixing device 9, the ejecting device 11, the sheet detecting sensor 17 and the pair of resist rollers 19 (not shown in FIG. 2).

The control part 21 controls the sheet feeding device 5, the image forming part 7, the fixing device 9 and the ejecting device 11 to perform the following image forming operation. The sheet feeding device 5 feeds the sheet S from the sheet feeding cassette 3 to the conveying path 15 when a printing start signal is received. After the sheet detecting sensor 17 detects the sheet S and then outputs a secondary feeding start signal, the pair of resist rollers 19 corrects a skew of the sheet S and then sends the sheet S to the image forming part 7. The image forming part 7 forms a toner image on the sheet S and then sends the sheet S to the fixing device 9. The fixing device 9 fixes the toner image on the sheet S and then sends the sheet S to the ejecting device 11. The ejecting device 11 ejects the sheet S on which the toner image is fixed to the ejected sheet tray 13.

Figure 3:
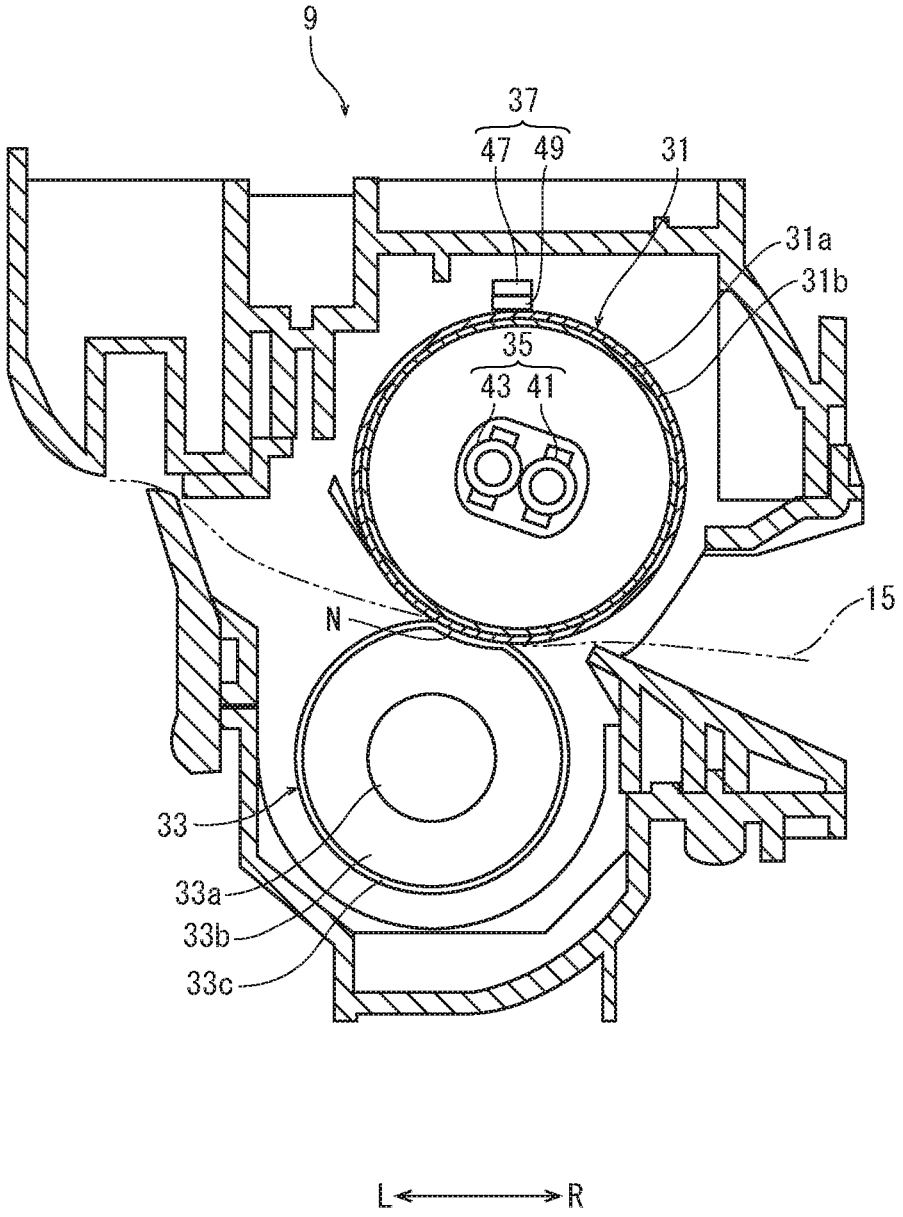
FIG. 3 is a sectional view showing a fixing device according to the embodiment of the present disclosure.
Figure 4:
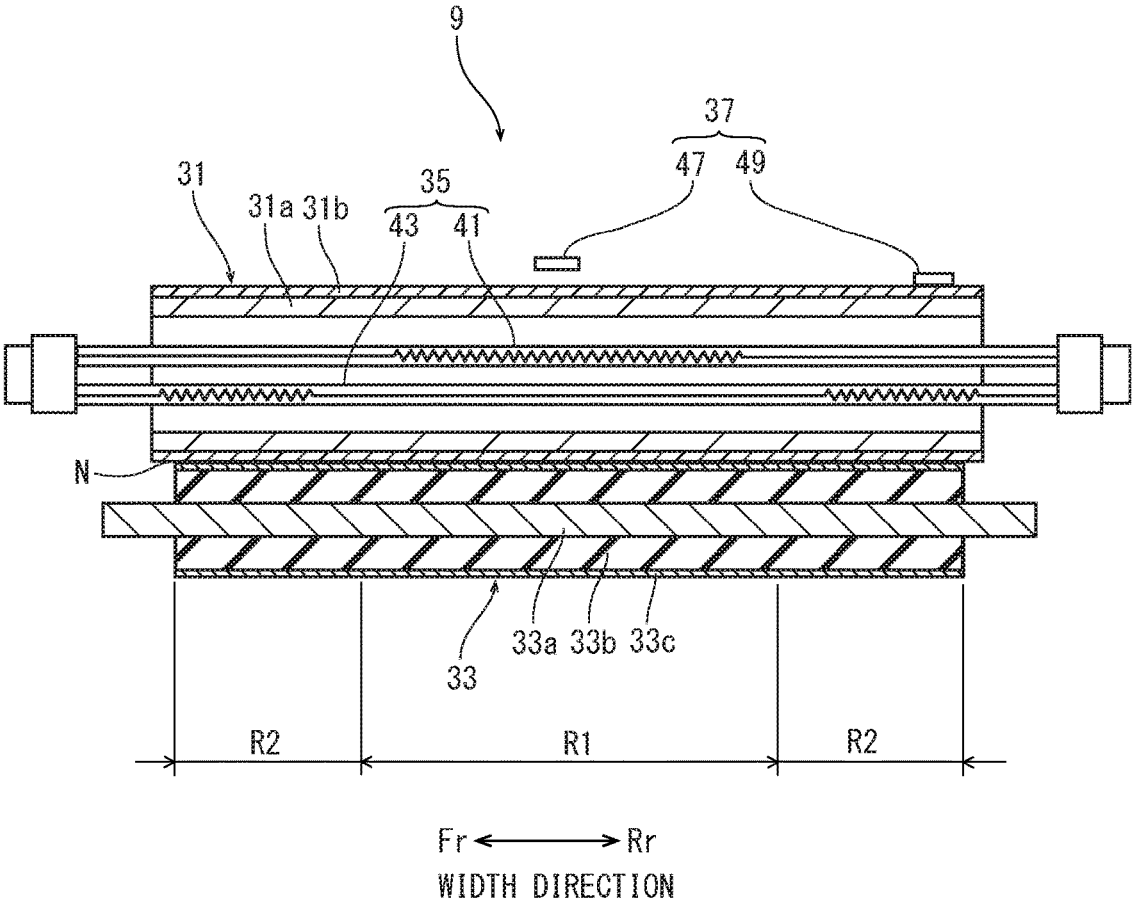
FIG. 4 is a sectional view showing the fixing device according to the embodiment of the present disclosure.

With reference to FIG. 3 and FIG. 4, the fixing device 9 will be described. FIG. 3 is a sectional view schematically showing the fixing device, and FIG. 4 is a sectional view schematically showing the fixing device.

As shown in FIG. 3, the fixing device 9 includes a fixing roller 31 as a fixing member, a pressing roller 33 as a pressing member which forms a pressing area N with the fixing roller 31, a heat source 35 heating the fixing roller 31 and a temperature sensor 37 as a detecting part detecting a temperature of the fixing roller 31.

The fixing roller 31 is formed in an inverted crown shape in which a diameter of the center portion in a sheet width direction perpendicular to a sheet conveying direction is smaller than that of the both end portions in the sheet width direction. The fixing roller 31 includes a cylindrical core metal 31*a* and a release layer 31*b* provided around the core metal 31*a* via an adhesion layer. The core metal 31*a* is made of aluminum, and has an outer diameter of 30 mm and a thickness of 0.6 mm, for example. The release layer 31*b* is made of tetrafluoroethylene-perfluoroalkyl vinyl ether copolymer (PFA), for example. The fixing roller 31 is rotatably supported around the core metal 31*a*.

The pressing roller 33 includes a rotating shaft 33*a*, an elastic layer 33*b* provided around the rotating shaft 33*a* and a release layer 33*c* provided around the elastic layer 33*b* via an adhesion layer. The rotating shaft 33*a* is made of a core metal and has a diameter of 23 mm, for example. The elastic layer 33*b* is made of silicon rubber, and has a thickness of 6 mm, for example. The release layer 33*c* is made of PFA tube, for example.

The pressing roller 33 is rotatably supported around the rotating shaft 33*a*. The pressing roller 33 is pressed against the fixing roller 31 from the lower side to form the pressing area N between the rollers 31 and 33. When the sheet S is passed through the pressing area N, the toner image is fixed on the sheet S.

Figure 5:
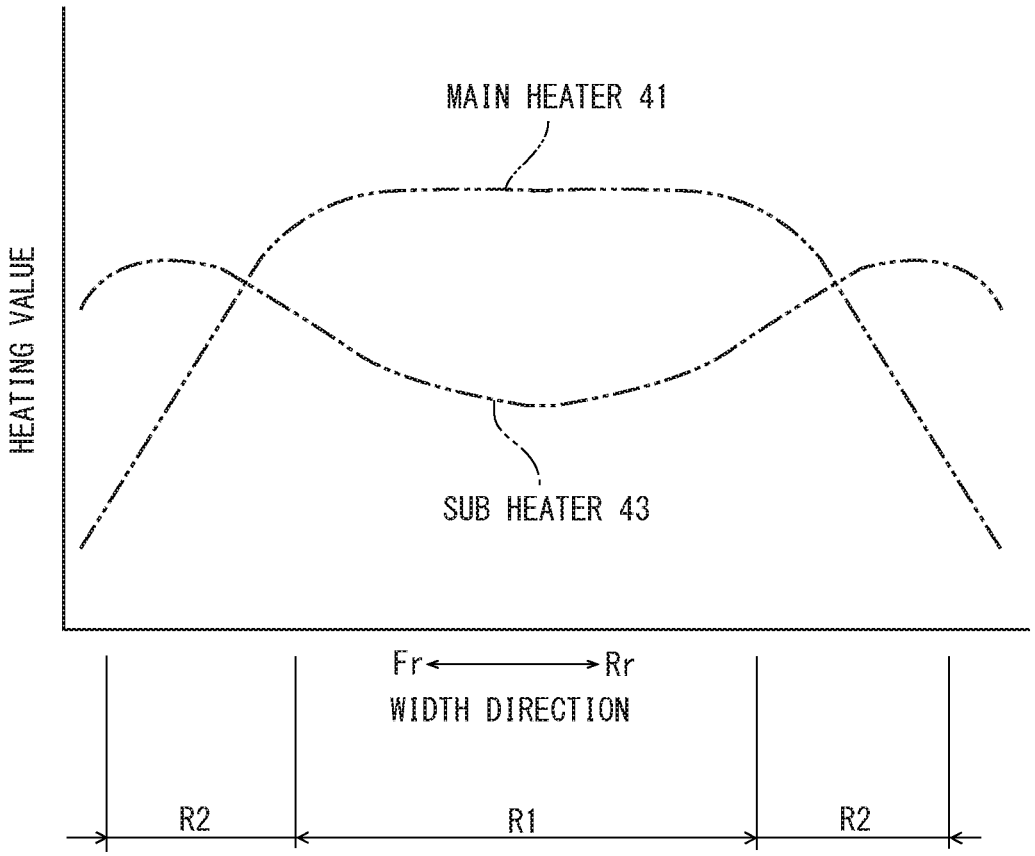
FIG. 5 is a graph showing heating values of a main heater and a sub heater in a width direction, in the fixing device according to the embodiment of the present disclosure.

With reference FIG. 5, in addition to FIG. 3 and FIG. 4, the heat source 35 will be described. FIG. 5 is s graph showing heating values of a main heater and a sub heater. The vertical axis indicates the heating value and the horizontal axis indicates a position of the fixing roller in the width direction.

As shown in FIG. 3 and FIG. 4, the heat source 35 includes a main heater 41 as a main heating part heating the center portion R1 of the fixing roller 31 in the sheet width direction and a sub heater 43 as a sub heating part heating the end portions R2 of the fixing roller 31 in the sheet width direction. The main heater 41 is a halogen heater having a heating value of 600 W, and the sub heater 43 is a halogen heater having a heating value of 400 W lower than that of the main heater 41. In view of fixing ability at continuous printing, the heating value of the main heater 41 is set to be larger than that of the sub heater 43.

As shown in FIG. 4, the main heater 41 has a filament arranged corresponding to the center portion R1 in the sheet width direction, and the sub heater 43 has filaments arranged corresponding to the both end portions R2 in the sheet width direction. By such an arrangement, as shown in FIG. 5, the heating value of the main heater 41 shows a peak at the center portion R1 and is small at the both end portions R2. On the other hand, the heating value of the main heater 41 shows peaks at the both end portions R2 and is small at the center portion R1.

The main heater 41 and the sub heater 43 are arranged with the main heater 41 at the upstream side and the sub heater 43 at the downstream side in the conveying direction, and are stored in a hollow space of the fixing roller 31. When power is applied to the main heater 41 and the sub heater 43, the heaters 41 and 43 are turned on to radiate radiation heat to an inner circumferential face of the fixing roller 31 and to heat the fixing roller 31. In detail, the main heater 41 mainly heats the center portion R1 of the fixing roller 31 in the sheet width direction, and the sub heater 43 mainly heats the both end portions R2 of the fixing roller 31 in the sheet width direction.

With reference to FIG. 3 and FIG. 4 again, the temperature sensor 37 includes a center sensor 47 detecting a temperature (a center temperature) of the center portion R1 of the fixing roller 31 and an end sensor 49 detecting a temperature (an end temperature) of one of the end portions R2 of the fixing roller 31. The center sensor 47 is a non-contact type thermistor, and the end sensor 49 is a contact type thermistor. The end sensor 49 comes into contact with the fixing roller 31 at a non-sheet passing area outside the sheet passing area in the sheet width direction. As shown in FIG. 2, the center sensor 47 and the end sensor 49 are electrically connected to the control part 21, and a data showing the center temperature detected by the center sensor 47 and a data showing the end temperature detected by the end sensor 49 are output to the control part 21.

An operation of the fixing device 9 having the above configuration will be described with reference to FIG. 6 and FIG. 7. FIG. 6 is a table showing a relationship between the end temperature and a delay time, and FIG. 7 is s flowchart showing the operation of the fixing device.

First, the delay time will be described. In a case where the center temperature and the end temperature of the fixing roller 31 are the same, because a heating value of the main heater 41 is larger than that of the sub heater 43 as described above, when the heaters 41 and 43 are turned on at the same time, a temperature rising time until the temperature rises to a fixing allowable temperature (for example, 180° C.) is shorter at the center portion than at the both end portions. Thereby, it is necessary to wait the start of the fixing operation until the end temperature rises to the fixing allowable temperature by a difference in the temperature rising time between the center portion and the both end portions. The difference in the temperature rising time between the center portion and the both end portions is defined to the delay time. Then, after the sub heater 43 is turned on, the main heater 41 is turned on after the delay time elapses, and the center temperature and the end temperature rise to the fixing allowable temperature at substantially the same time.

FIG. 6 is a table showing an example of a relationship between the end temperature and the delay time in a case where the center temperature and the end temperature of the fixing roller 31 are the same. In case of the end temperature less than 35° C., the delay time is set to 4 seconds. When the end temperature is relatively low, because a long time is required to rise the end temperature to the fixing allowable temperature, the delay time is set to be long. The delay time becomes short as the end temperature is high. In a case of the end temperature larger than 150° C., because it is the same as the fixing allowable temperature, if the main heater 41 is turned on first without the delay time, the difference in the temperature rising time is not generated.

Figure 7:
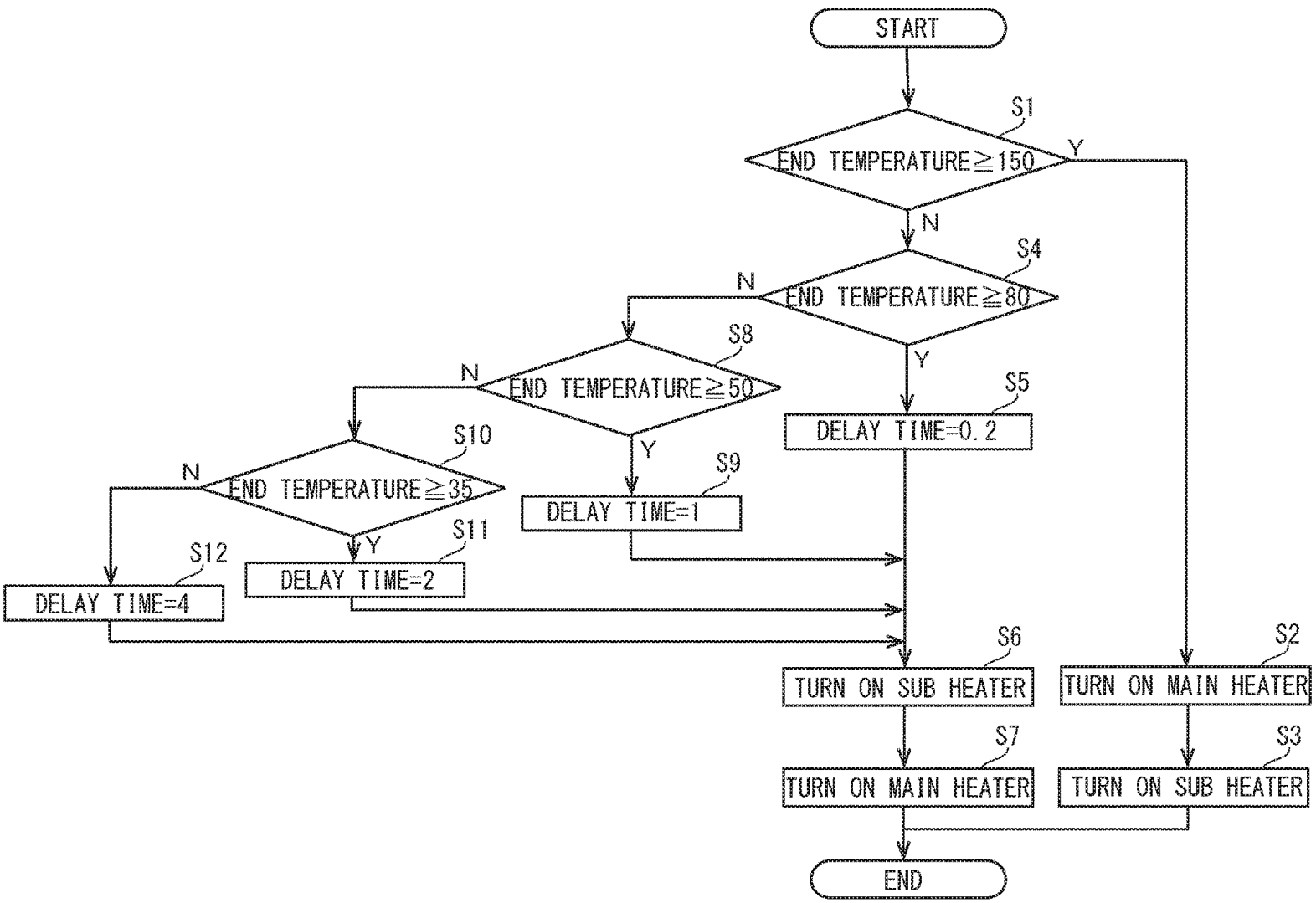
FIG. 7 is a flowchart showing a fixing operation, in the fixing device according to a conventional embodiment.

With reference to FIG. 7, the operation of the fixing device 9 will be described. When the printing signal is input, at step S1, a data showing the end temperature detected by the end sensor 49 is send to the control part 21, the control part 21 determines whether the end temperature is higher than 150° C. or not. When it is determined that the end temperature is higher than 150° C. at step S1, because the end temperature is the same as the fixing allowable temperature as described above, it is determined that the delay time is not required. Then, at step S2, the main heater 41 is turned on, and then, at step S3, the sub heater 43 is turned on after a predetermined period (for example, 0.2 seconds) elapses.

On the other hand, when it is determined that the end temperature is not higher than the 150° C. at step S1, it proceeds to step S4. At step S4, the control part 21 determines whether the end temperature is higher than 80° C. or not. When, at step S4, it is determined that the end temperature is 80° C. or higher, it proceeds to step S5. At step S5, the control part 21 sets the delay time to 0.2 seconds based on the table shown in FIG. 7.

Then, it proceeds to step S6. At step S6, the sub heater 43 is turned on and then it proceeds to step S7. At step S7, the main heater 41 is turned on after the set delay time of 0.2 seconds elapses.

When it is determined that the end temperature is not higher than 80° C. at step S4, it proceeds to step S8. At step S8, the control part 21 determines whether the end temperature is higher than 50° C. or not. When it is determined that the end temperature is 50° C. or higher at step S8, it proceeds to step S9. At step S9, the control part 21 sets the delay time to 1 second based on the table shown in FIG. 7. Then, it proceeds to step S6. At step S6, the sub heater 43 is turned on and then it proceeds to step S7. At step S7, the main heater 41 is turned on after the set delay time of 1 second elapses.

When it is determined that the end temperature is not higher than the 50° C. at step S8, it proceeds to step S10. At step S10, the control part 21 determines whether the end temperature is higher than 35° C. or not. When it is determined that the end temperature is 35° C. or higher, it proceeds to step S11. At step S11, the control part 21 sets the delay time to 2 seconds based on the table shown in FIG. 7. Then, at step S6, the sub heater 43 is turned on and then it proceeds to step S7. At step S7, the main heater 41 is turned on after the set delay time of 2 seconds elapses.

When it is determined that the end temperature is not higher than the 35° C. at step S10, it proceeds to step S12. At step S12, the control part 21 sets the delay time to 4 seconds based on the table shown in FIG. 7. Then, at step S6, the sub heater 43 is turned on and then it proceeds to step S7. At step S7, the main heater 41 is turned on after the set delay time of 4 seconds elapses.

Figure 8:
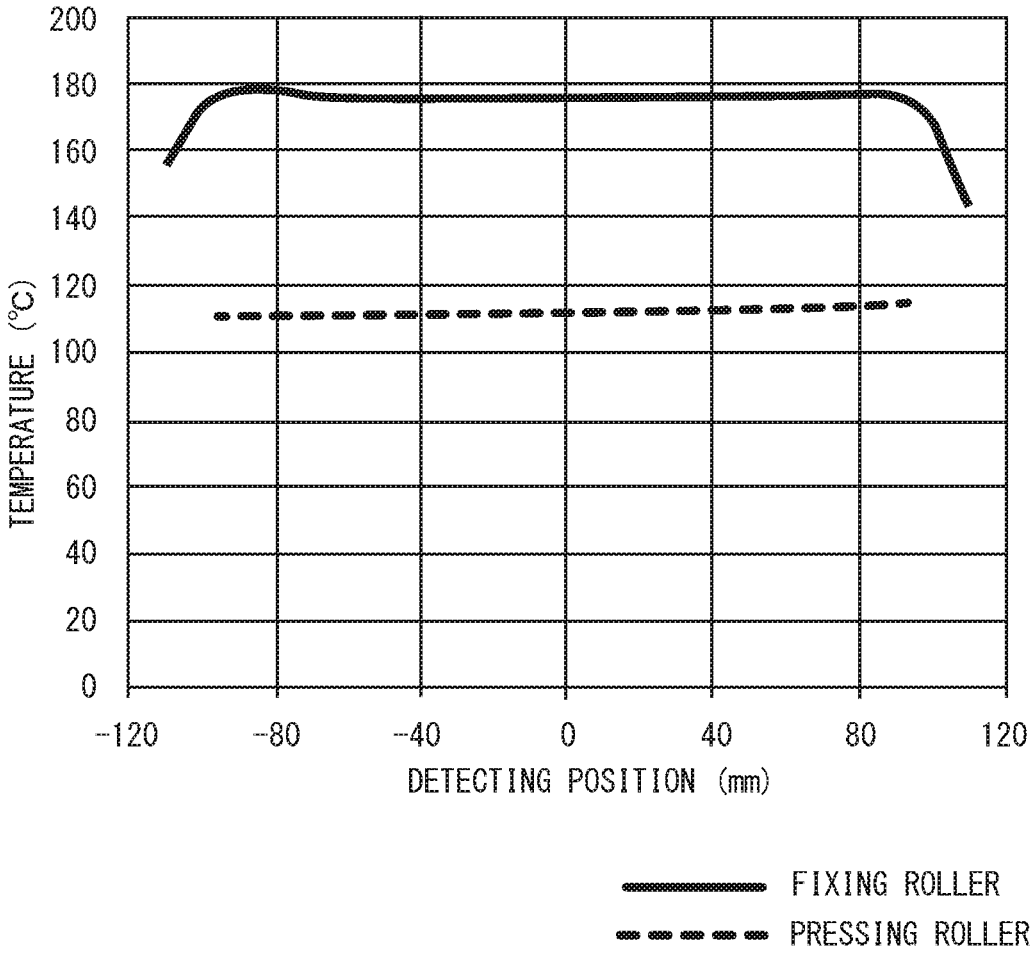
FIG. 8 is a graph showing a temperature distribution of the fixing roller and a pressing roller in the width direction, in the fixing device according to the conventional embodiment.

For example, in a case of the end temperature less than 35° C., the sub heater 43 is turned on and then the main heater 41 is turned on after 4 seconds elapses. Then, after 12 seconds elapses, the center temperature and the end temperature rise to the fixing allowable temperature at substantially the same time. A temperature distribution of this case is shown in a graph of FIG. 8. The vertical line indicates a temperature, and the horizontal line indicates a position of the fixing roller in the width direction. The solid line indicates the temperature of the fixing roller, and the broken line indicates the temperature of the pressing roller.

As shown in the graph, the center portion and the end portions of the fixing roller 31 are uniformly heated to about 180° C. The pressing roller 3 which comes into contact with the fixing roller 31 and is heated is heated to about 110 to 120° C. substantially uniformly in the width direction.

As described above, according to the fixing device 9 of the present disclosure, because the temperature rising rate of the end portion of the fixing roller 31 is rate limitation of the fixing operation, operating timings of the main heater 41 and the sub heater 43 are determined based on the end temperature, and then the center portion and the end portion are heated to a constant temperature (the fixing allowable temperature) at substantially the same time. Accordingly, it is not required to generate heat consumption for tuning on/off of the main heater 41 until the sub heater 43 heats the end portions to the fixing allowable temperature.

Specifically, in a case of the end temperature lower than the fixing allowable temperature, the main heater 41 is turned on after the sub heater 43 is turned on, and the center portion and the end portions are heated to the fixing allowable temperature at substantially the same time. Additionally, because the delay time becomes long as the end temperature is low, it becomes possible to heat the fixing roller 31 suitably depending on the environment of the fixing device 9. Additionally, it becomes possible to control the printing timing in response to the timing when the center portion and the end portions are heated to the fixing allowable temperature at the same time. Therefore, the fixing device 9 usable without giving stress to a user can be provided.

Additionally, because the main heater 41 and the sub heater 43 are turned on by time difference, it becomes possible to eliminate increasing the rush current.

Additionally, because the fixing roller 31 is formed in an inverted crown shape, a length of the pressing area in the rotating direction of the fixing roller 31 is longer at the both end portions than at the center portion. Then, if the fixing roller 31 is heated with a constant heating value, a fixing ability (an ability for heating the toner and fixing the toner on the sheet) is larger at the both end portions than at the center portion. Accordingly, in a case of the relatively low end temperature, it becomes possible to heat the fixing roller 31 uniformly without increasing the delay time excessively.

In the present embodiment, the delay time is determined based on the table shown in FIG. 7. However, the delay time may be determined using a calculation expression based on the detected end temperature. For example, in a case where a temperature rising rate of the center portion of the fixing roller 31 (ΔTc) is 20 (° C./second), a temperature rising rate of the both end portions of the fixing roller 31 (ΔTe) is 10 (° C./second), the fixing allowable temperature of the center portion (Tc) is 180 (° C.) and the fixing allowable temperature of the both end portions (Te) is 150 (° C.), when the detected temperature of the end portion (Tx) is 50 (° C.), the delay time (Dt) is set as follows.

The delay time ($Dt$)=(the fixing allowable temperature of the end portions ($Te$)−the detected temperature of the end portion ($Tx$))/the temperature rising rate of the end portion ($\Delta Te$)−(the fixing allowable temperature of the center portion ($Tc$)−the detected temperature of the end portion ($Tx$)/the temperature rising rate of the center portion ($\Delta Tc$)=(150−50)/10−(180−50)/20=3.5.

In the present embodiment, the main heater 41 and the sub heater 43 as the heat source are the halogen heaters. As the heat source, an IH heater may be used. In this case, the IH heater is configured to heat the center portion and the both end portions separately, and set heat amount of the center portion larger than that of both end portions.

While the above description has been described with reference to the particular illustrative embodiments of the fixing device and the image forming apparatus according to the present disclosure, a technical range of the disclosure is not to be restricted by the description and illustration of the embodiment.

The invention claimed is:

1. A fixing device comprising:

a fixing member, a pressing member which forms a pressing area with the fixing member, a sheet being conveyed through the pressing area;

a heat source including a main heating part heating a center portion of the fixing member in a sheet width direction perpendicular to a conveying direction of the sheet and a sub heating part heating both end portions of the fixing member in the sheet width direction;

a detecting part detecting a temperature of the end portion of the fixing member; and a control part determining operation timings of the main heating part and the sub heating part based on the temperature detected by the detecting part such that the center portion and the both end portions of the fixing member are heated to a constant temperature, wherein the control part delays the operation timing of the main heating part by a delay time Dt (second) from the operation timing of the sub heating part when the temperature detected by the detecting part is equal to a predetermined temperature or lower, wherein the delay time Dt (second) is obtained by the following manner, when a temperature rising rate of the center portion of the fixing member is set to ΔTc (° C./second);

a temperature rising rate of the both end portions of the fixing member is set to ΔTe (° C./second);

a fixing allowable temperature of the center portion of the fixing member is set to Tc (° C.);

a fixing allowable temperature of the end portions of the fixing member is set to Te (° C.); and a temperature detected by the detecting part is set to Tx (° C.), the delay time $Dt$ (second)=($Te$−$Tx$)/$\Delta Te$−($Tc$−$Tx$)/$\Delta Tc$.

2. The fixing device according to claim 1, wherein a delay time of the main heating part is long as the temperature detected by the detecting part is low.

3. The fixing device according to claim 1, wherein the fixing member is a fixing roller formed in an inverted crown shape in which an outer diameter of the center portion is smaller than outer diameters of the both end portions.

4. An image forming apparatus comprising:

an image forming part which forms a toner image on a sheet; and the fixing device according to claim 1, which fixes the toner image on the sheet.

* * * * *